US009095739B2

(12) United States Patent
Sillik

(10) Patent No.: US 9,095,739 B2
(45) Date of Patent: Aug. 4, 2015

(54) TRAINING BAT

(71) Applicant: Francisco J. Sillik, Tucson, AZ (US)

(72) Inventor: Francisco J. Sillik, Tucson, AZ (US)

( * ) Notice: Subject to any disclaimer, the term of this patent is extended or adjusted under 35 U.S.C. 154(b) by 46 days.

(21) Appl. No.: 14/143,804

(22) Filed: Dec. 30, 2013

(65) Prior Publication Data

US 2015/0182770 A1 Jul. 2, 2015

(51) Int. Cl.

| | |
|---|---|
| ***A63B 69/00*** | (2006.01) |
| ***A63B 59/06*** | (2006.01) |
| ***A63B 15/00*** | (2006.01) |

(52) U.S. Cl.

CPC ..... *A63B 15/005* (2013.01); *A63B 69/0002* (2013.01); *A63B 2069/0008* (2013.01)

(58) Field of Classification Search

USPC ..... 473/457, 519, 520, 564–568, 334–339
See application file for complete search history.

(56) References Cited

U.S. PATENT DOCUMENTS

| | | | | |
|---|---|---|---|---|
| 514,420 | A | 2/1894 | Jacobus | |
| 3,113,782 | A | 12/1963 | Guier | |
| 3,136,546 | A | 6/1964 | Connolly | |
| 3,137,504 | A | 6/1964 | Zordan et al. | |
| 3,578,801 | A | 5/1971 | Piazza | |
| 4,274,631 | A * | 6/1981 | Hayazaki | 473/457 |
| 4,325,549 | A * | 4/1982 | Vasselli | 473/519 |
| 4,600,190 | A * | 7/1986 | Berokoff | 482/129 |
| 4,671,508 | A | 6/1987 | Tetreault | |
| 4,898,386 | A * | 2/1990 | Anderson | 473/457 |
| 4,900,038 | A * | 2/1990 | Czetto et al. | 473/570 |
| 5,133,551 | A | 7/1992 | Handy et al. | |
| 5,590,875 | A * | 1/1997 | Young | 473/457 |
| 7,147,580 | B2 * | 12/2006 | Nutter et al. | 473/457 |
| 2014/0121042 | A1 * | 5/2014 | Nutter | 473/457 |
| 2014/0135154 | A1 * | 5/2014 | Pegnatori | 473/520 |

FOREIGN PATENT DOCUMENTS

| | | |
|---|---|---|
| GB | 2222092 | 2/1990 |

* cited by examiner

*Primary Examiner* — Mark Graham
(74) *Attorney, Agent, or Firm* — Quarles & Brady LLP; Gavin J. Milczarek-Desai

(57) ABSTRACT

A bat that includes a hollow body defining a interior volume extending within a barrel portion of the bat and a slidable mass having an passage that extends through the mass in the direction of movement. The slidable mass is contained within the interior volume and is in contact with an interior circumference of the hollow body. As a user swings the bat, the moment of inertia for the bat changes such that swing mechanics and timing are improved.

6 Claims, 2 Drawing Sheets

TRAINING BAT

BACKGROUND OF THE INVENTION

The invention relates generally to sports training devices and more particularly in some embodiments to baseball/softball training bats designed to improve swing timing and mechanics.

DESCRIPTION OF THE RELATED ART

Training bats or clubs with either a cylindrical or spherical stationary weight are well known. Many a baseball training bat involves "donuts" or other weights which are used primarily to develop strength or practice and perfect the swinging technique of the hitter. Such structures have included bats having unusual weight distribution as well as bats having removable or movable weights supported therein or thereon.

For example, U.S. Pat. No. 514,420 disclosed a bat in which an impact force multiplying device is provided. The impact device includes an elongated hollow passage defined within the striking end of the bat within which a plurality of weighted spherical balls are freely movable. A closure plug is threadably received at the striking end of the bat closing the passage and captivating the weighted balls within the passage. In an alternate embodiment, an elongated cylindrical sliding weight replaces the spherical balls. The intended function is provided by the change of bat characteristic during swinging as centrifugal force drives the weighted members outwardly from the passage end remote from the striking end to the striking end of the bat.

Another example includes U.S. Pat. No. 3,578,801, which sets forth a practice bat having an elongated hollow bat for baseball practice within which an elongated longitudinal rod is supported. A chamber extends along a portion of the elongated rod and supports a slidable weight thereon. During the swinging of the bat, the centrifugal force drives the weight outwardly toward the striking end of the bat.

While the foregoing devices are useful for their intended purposes, there remains a continuing need in the art for evermore improved practice devices such as game bats or the like.

SUMMARY OF THE INVENTION

The disclosure relates in general to practice device such as a bat that has a hollow body defining a interior volume extending within a barrel portion of the bat. The interior volume includes a slidable mass having a passage that extends through the mass in the direction of movement. Moreover, the slidable mass is contained within the bat's interior volume and is in contact with an interior circumference of the bat, thereby slidably engaged along the bat's interior circumference during a swinging motion.

The slidable mass means a changing (dynamic) moment of inertia (MOI). Therefore, embodiments may include a passage in the mass that has a different diameter at each end or within the passage, thereby providing a way to control the rate of change of the inertia (i.e., a control mechanism for dynamic MOI).

The moment of inertia changes as the mass moves further from the center of rotation. The following relationships describe this effect:

I=moment of inertia=the moment of inertia of the bat (I bat)+the product of the mass of slider times the square of the distance ($r^2$) from the center of rotation. Thus, I total=I bat+ slider mass$\times r^2$ where r increases.

Various other purposes and advantages of the invention will become clear from its description in the specification that follows. Therefore, to the accomplishment of the objectives described above, this invention includes the features hereinafter fully described in the detailed description of the preferred embodiments, and particularly pointed out in the claims. However, such description discloses only some of the various ways in which the invention may be practiced.

DETAILED DESCRIPTION OF THE PREFERRED EMBODIMENTS

Figure 2:
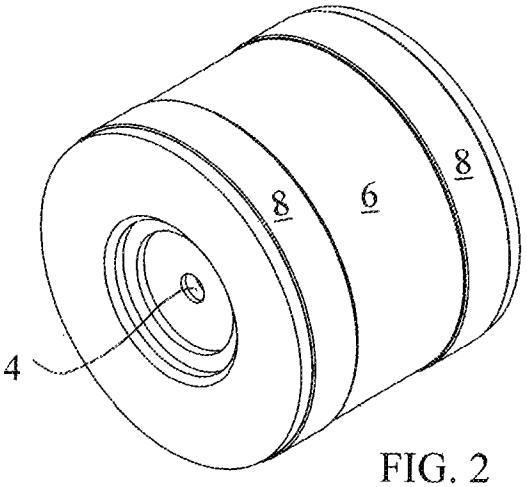
FIG. 2 depicts a back perspective view of the embodiment of a slidable mass for the inventive bat shown in FIG. 1.

Referring to FIGS. 1-4 and 6, a slidable mass 2 is shown having a passage 4 that extends through the mass in the direction of movement M. The slidable mass 2 is generally cylindrical (although ovoid and other shapes are possible) and may be made of metal such as steel or aluminum depending on the amount of weight desired. While not shown in the drawings, it should be understood that more than one mass 2 may be included or that "stackable" or "nesting" masses may be used in lieu of a single slidable mass, thereby giving the ability for both customizing both the amount of weight and the "feel" of the bat. A coating or lubricant may be used on the mass 2 and/or inner surface of the bat to aid in sliding.

The mass 2 further includes an outer surface 6 that preferably contains one or more seal(s) 8 to provide a smooth sliding motion. For example, a pair of seals disposed around a circumference of the mass 2 proximal to each end of the mass may be utilized. In the finished training bat, the seal(s) 8 are in contact with an interior circumference of the bat as shown FIGS. 6 and 7 and described in further detail below and may be made of a material allows for sliding movement, such as nylon or polytetrafluoroethylene, against the interior surface of the bat. While the seal(s) are shown to be anular in structure, any other configuration that allows sliding of the mass 2 while in contact with the inner circumference of the bat may be used.

Figure 4:
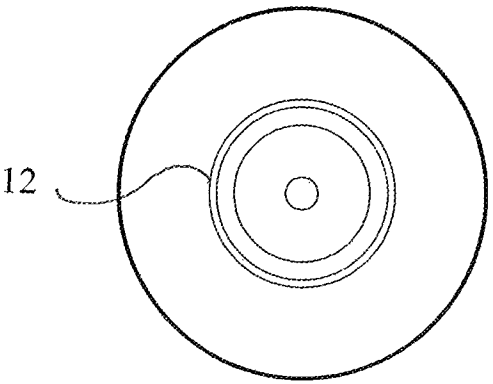
FIG. 4 depicts a back elevational view of the embodiment of the slidable mass shown in FIG. 2.
Figure 1:
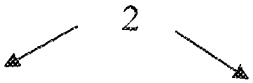
FIG. 1 depicts a front perspective view of an embodiment of a slidable mass for the inventive bat.
Figure 1:
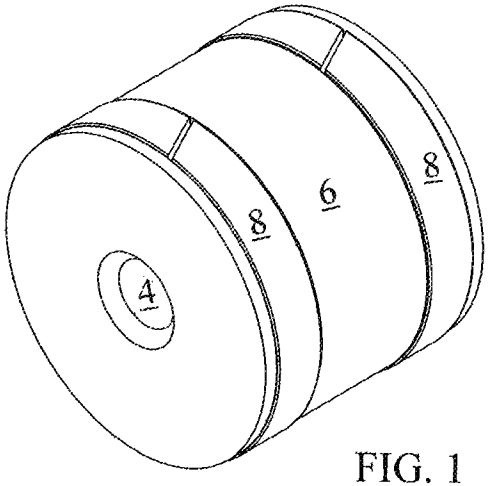
Figure 3:
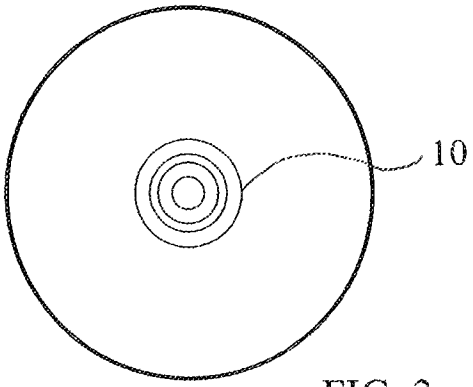
FIG. 3 depicts a front elevational view of the embodiment of the slidable mass shown in FIG. 1.

The passage 4 that extends through the slidable mass 2 preferably has a different diameter at each end of the mass, for example, diameter 10 and diameter 12 in FIGS. 3 and 4, respectively. The different diameter openings may extend a predetermined distance through the mass 2, as shown for example in FIG. 6, thereby causing the passage to have different diameters. By having different diameters for the passage, the speed of motion for the mass 2 is more precisely controllable, leading to different effects during a swing motion. For example, with the mass located close to the center of rotation at the start of a swing, the smaller inertia allows control and enhanced bat angular acceleration. Under a force due to centripetal acceleration, the mass slides outward. The orifice provides a method of controlling the rate at which the mass moves toward the end of the bat, with the purpose of optimizing the location of the sweet spot (center of percussion) at the time of bat and ball impact, and as the mass moves further outboard, providing increased inertia which aids in the training of swing follow through.

Figure 7:
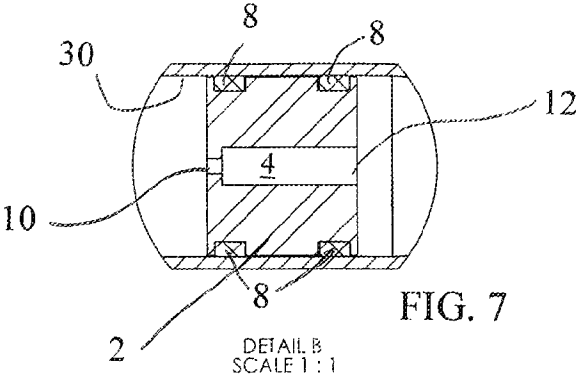
FIG. 7 depicts an enlarged cross-sectional view of the slidable mass in the embodiment shown in FIG. 6 and taken along the section defined by circle B.
Figure 6:
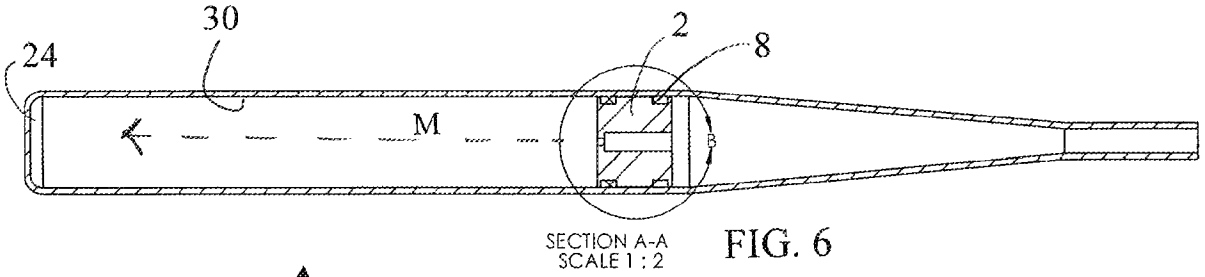
FIG. 6 depicts a cross-sectional view of the embodiment shown in FIG. 5 and taken along line A-A.
Figure 5:
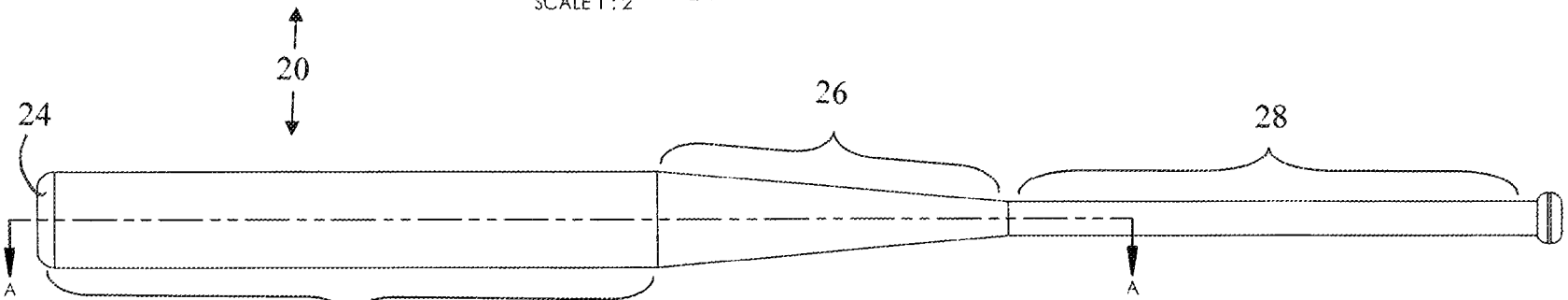
FIG. 5 depicts a side elevational view of an embodiment of the inventive bat.

Turning to FIGS. 5-7, an embodiment of an inventive bat 20 utilizing the sliding mass described above is shown. The bat includes a relatively thick barrel portion 22 topped by an end cap 24, which may act as a stop for the mass 2 and thus be made of rubber or a similar material, a junction or handle taper portion 26, and a handle portion 28. Different bat styles may be used, with or without an end cap, depending on desired characteristics and ability to change or alter the slidable mass 2.

The slidable mass shown in this embodiment is free from contact with any structure within the barrel portion 22 except for the interior circumference 30 upon which it slides and the end cap 24 (other embodiments may not have an end cap, however, in which case the mass contacts the end of the barrel portion 22). Hence, during a bat user's swing, the mass 2 will move M toward the bat end/end cap while air goes through the passage 4.

While not intending to limit this disclosure to any particular mechanism of action, the following explanation of the mechanics of the inventive bat is provided. The slidable mass 2 provides a dynamic Moment Of Inertia (MOI) with a reduced initial MOI prior to initiating a swing. In the action of swinging the bat, a centripetal acceleration acts on the bat causing a shift in position of the slidable mass, which increases the MOI as the swing progresses.

In other words, the reduced MOI at the beginning of the swing allows the batter to achieve a higher swing speed with more control up to the point of ball contact. With the increased MOI in the later part of the swing, the bat user is trained to follow through the swing after the ball/bat contact is completed.

Moment of inertia is a physical property which provides a measure of a body's resistance to a change in its angular rotation velocity. The determination of MOI is accomplished by defining a group of small individual mass particles, the sum of which equals the total mass, and defining the distance ($r_i$) of the mass particles ($m_i$) from a specified axis of rotation. The MOI can then be calculated as:

$$I_P = \sum_{i=1}^{N} m_i r_i^2.$$

Where N is the total number of discrete particles and subscript p is the point through with the axis of rotation passes Thus, the inventive bat works by the movement of the mass due to centripetal acceleration toward a closed volume of air in the end of the bat. The action of the moving slidable mass compresses the air into a smaller volume with higher pressure, causing the air to flow through an passage through the center of the mass. The passage restricts the flow providing a control mechanism for the rate of slider movement, and hence the change of MOI. Consequently, the swing dynamics can be customized for the strength and other attributes of different hitters.

Various changes in the details and components that have been described may be made by those skilled in the art within the principles and scope of the invention herein described in the specification and defined in the appended claims. Therefore, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent processes and products.

What is claimed is:

1. A bat, comprising:

a hollow body defining a interior volume extending within a barrel portion of the bat; and a slidable mass having a passage that extends through the mass in the direction of movement, wherein the slidable mass is contained within said interior volume and is in contact with an interior circumference of said hollow body, wherein said passage that extends through the mass has a different diameter at each end of said mass.

2. The bat of claim 1, wherein said slidable mass further includes a seal disposed around a circumference of said mass such that said seal is in contact with said interior circumference of said hollow body.

3. The bat of claim 1, wherein said slidable mass further includes a pair of seals disposed around a circumference of said mass proximal to each end of the mass and such that said pair of seals are in contact with said interior circumference of said hollow body.

4. The bat of claim 1, wherein said slidable mass is free from contact with any structure within said barrel except said interior circumference and an end cap or bat end.

5. The bat of claim 2, wherein said slidable mass is free from contact with any structure within said barrel except said interior circumference and an end cap or bat end.

6. The bat of claim 3, wherein said slidable mass is free from contact with any structure within said barrel except said interior circumference and an end cap or bat end.

* * * * *